US011440718B2

(12) United States Patent
Deis

(10) Patent No.: US 11,440,718 B2
(45) Date of Patent: Sep. 13, 2022

(54) CUSHIONING MATERIAL FOR PACKAGING PURPOSES, AND METHOD FOR CUSHIONING AN OBJECT

(71) Applicant: Storopack Hans Reichenecker GMBH, Metzingen (DE)

(72) Inventor: Paul Deis, Preuschdorf (FR)

(73) Assignee: Storopack Hans Reichenecker GMBH, Metzingen (DE)

( * ) Notice: Subject to any disclaimer, the term of this patent is extended or adjusted under 35 U.S.C. 154(b) by 264 days.

(21) Appl. No.: 16/630,984

(22) PCT Filed: Jul. 24, 2018

(86) PCT No.: PCT/EP2018/070045

§ 371 (c)(1),
(2) Date: Jan. 14, 2020

(87) PCT Pub. No.: WO2019/020631

PCT Pub. Date: Jan. 31, 2019

(65) Prior Publication Data

US 2020/0223613 A1 Jul. 16, 2020

(30) Foreign Application Priority Data

Jul. 27, 2017 (DE) ..... 10 2017 117 001.4

(51) Int. Cl.
*B65D 85/00* (2006.01)
*B65D 81/03* (2006.01)
*B65B 55/20* (2006.01)

(52) U.S. Cl.
CPC ..... *B65D 81/03* (2013.01); *B65B 55/20* (2013.01)

(58) Field of Classification Search
CPC .... B65D 81/03; B65D 81/052; B65D 81/022; A61B 2050/318; A61B 2050/002; B65B 55/20

(Continued)

(56) References Cited

U.S. PATENT DOCUMENTS 3,288,353 A 11/1966 McCullough
5,791,476 A * 8/1998 Stekloff ..... B65D 31/12 206/521

(Continued)

FOREIGN PATENT DOCUMENTS

DE 43 07 029 A1 9/1994
DE 20 2005 006 427 U1 7/2005

(Continued)

OTHER PUBLICATIONS

PCT/EP2018/070045 International Search Report dated Nov. 14, 2019.

(Continued)

*Primary Examiner* — King M Chu
(74) *Attorney, Agent, or Firm* — Wood Herron & Evans LLP

(57) ABSTRACT

A cushioning material for packaging comprises at least one sheetlike element having at least one edge portion and one cushion portion providing a property desired for protecting an item to be packaged. It is proposed that an adhesive system is applied to at least one edge portion, at least in some regions, and is designed for a releasable connection to a different section of another sheetlike element or of the same sheetlike element without auxiliary means and non-destructively.

9 Claims, 6 Drawing Sheets

(58) Field of Classification Search
USPC ..... 206/459.5, 438, 521, 522
See application file for complete search history.

(56) References Cited

U.S. PATENT DOCUMENTS

| | | | | |
|---|---|---|---|---|
| 2009/0078590 | A1* | 3/2009 | Smith | B65B 61/18 206/39 |
| 2009/0107862 | A1* | 4/2009 | Pascua | B65D 75/20 206/232 |
| 2013/0216788 | A1 | 8/2013 | Schellenberger | |

FOREIGN PATENT DOCUMENTS

| | | |
|---|---|---|
| DE | 20 2006 007 031 U1 | 8/2006 |
| DE | 20 2013 002 120 U1 | 3/2013 |
| DE | 10 2012 102 432 B4 | 8/2013 |

OTHER PUBLICATIONS

PCT/EP2018/070045 Written Opinion dated Jul. 24, 2018.
German 10 2017 117 001.4 Office Action dated Mar. 1, 2018.

* cited by examiner

CUSHIONING MATERIAL FOR PACKAGING PURPOSES, AND METHOD FOR CUSHIONING AN OBJECT

The invention relates to a cushioning material for packaging purposes, and a method for cushioning an item according to the preambles of the respective dependent claims.

From the marketplace, it is known to protect items to be transported or shipped from impact or other harmful external influences by wrapping these items with a cushioning material. Such a cushioning material may be, for example, a bubble wrap made of plastic, or another three-dimensional cushioning material which has, for example, bulges similar to an egg carton.

A problem with the known material, however, is that the handling is time consuming. If the item is wrapped with the cushioning material, measures must be taken to prevent the wrapping from coming loose. For example, adhesive strips or cords or the like are used for this purpose. Alternatively or additionally, the item must be wrapped many times to prevent detachment of the wrapping. This is complex and requires the handling of additional elements.

The object of the present invention is to provide a cushioning material and a method which is particularly simple and suitable for protecting an item to be packaged.

This object is achieved by a cushioning material having the features of claim 1 and a method having the features of the independent claim. Advantageous further developments of the invention are specified in subclaims. In addition, further features essential to the invention can also be found in the following description and in the drawing. These features may be essential to the invention, both alone and in different combinations, without this being explicitly referred to again.

The cushioning material for packaging purposes according to the invention comprises at least one sheetlike element which has at least one edge portion and one cushion portion. It is not essential that the cushion portion has a different configuration from the edge portion. Rather, the cushion portion may of course extend to the edge of the edge portion. The two portions differ only by the primary function in that the cushion portion is primarily cushioned, whereas the edge portion primarily delimits the sheetlike element. It should also be noted at this point that a sheetlike element by no means must be flat and smooth, but of course may have one or more curves and a relevant thickness. "sheetlike" in this context merely means that the thickness is smaller than either of the other two Cartesian dimensions.

The cushion portion provides a property desired for protecting an item to be packaged. An adhesive system is applied to at least some regions of at least one edge portion and is designed for a releasable connection to a different portion of a different sheetlike element or of the same sheetlike element without auxiliary means, that is, for example, without special heating and without special tools, and non-destructively, thus, without damaging the cushioning material or the item.

The method according to the invention comprises the following steps: wrapping the item with a sheetlike element or a plurality of associated sheetlike elements; attaching at least one edge portion of the sheetlike element or the sheetlike elements by means of the releasable adhesive system, in particular with another edge portion of the sheetlike element or of another sheetlike element.

Thanks to the invention, the person who packs an object to be protected with the cushioning material according to the invention does not have to manipulate any additional elements, such as dispensers for tape, cords, etc. to reliably secure the cushioning material. Instead, the cushioning material itself has an adhesive system which makes it possible to reliably connect one edge portion of the sheetlike element of the cushioning material to another portion of the same sheetlike element or to a portion of another sheetlike element. This makes it possible to forego repeated wrapping of the item to be protected, thereby saving on cushioning material. This protects the environment and reduces costs.

The adhesive system is designed so that the edge portion can be released from the other portion at any time without auxiliary means and non-destructively. In this way, for example, a repositioning of the edge portion of the sheetlike element is possible already during the packaging process in order to optimize the protection of the item. In addition, at any time, for example, the recipient of the item can remove the cushioning material without needing any auxiliary means. Overall, this significantly increases the efficiency of packaging an item.

In a first further development, it is proposed that the releasable adhesive system be designed so that it can be used at least one more time after releasing for a reattachment, in particular so that the releasable adhesive system has an adhesive layer with a sticky-note-adhesive effect, for example à la Post-it®. Thus, the cushioning material can be easily removed from the item en route from the sender to the recipient, for example for inspection purposes, in such a way that the cushioning material is not damaged. After removal of the cushioning material, the same cushioning material can be reattached to the item. This also simplifies handling and reduces costs. In addition, the storage and the provision of the cushioning material is simplified, since the cushioning material can be rolled up while in a storage state, for example on a roll, with a zig-zag folding or simply placed as a stack of individual sheetlike elements in a container without the adhesive system requiring a separate covering. This also facilitates handling, speeds up the application and lowers the manufacturing and processing costs.

It is also possible that the adhesive system comprises an adhesive strip extending continuously along the edge portion. As a result, a maximum flexibility in the handling of the cushioning material is produced, because a relatively high adhesive surface is provided. It is understood that the adhesive strip viewed over its length can have a constant width, but also a preferably periodically variable width. In this way, a desired adhesive force can be set.

Alternatively or additionally, it is possible for the adhesive system to comprise a non-continuous adhesive strip extending along the edge portion and/or individual adhesive dots. This makes it possible to reduce the adhesive force compared to a continuous adhesive strip and to reduce the cost of the adhesive system. In addition, a desired adhesive force can be set in a simple manner, by the density of the non-continuous adhesive strips or the individual adhesive dots being selected accordingly.

It is particularly advantageous if the sheetlike element is rectangular in plan view, and if the edge portion on which the adhesive system is applied is at least one longitudinal edge and/or at least one transverse edge. A rectangular sheetlike element can be used for many purposes, and the adhesive system can be applied very easily to a generally straight edge portion of such a rectangular sheetlike element.

Another particularly preferred embodiment of the cushioning material according to the invention is characterized in that the cushion portion is made of a paper or cardboard material in which a plurality of bulges is formed. Such a material is relatively pleasant and "soft" to handle and is an advantageous ecological alternative to, for example, a plastic bubble wrap. The bulges provide for a relatively large three-dimensional volume, whereby the item to be packaged is particularly well protected from impact and damage. At the same time, the bulges ensure a relatively low density, which saves weight.

In a further development, it is proposed that a bulge toward one side of the sheetlike element is adjacent to a bulge toward the other side of the sheetlike element. As a result, the three-dimensional volume is increased again and in this way the cushioning effect is improved without additional weight being produced in the process.

It is also advantageous if the sheetlike element is releasably connected, at least in a storage state, to a further sheetlike element by means of a tear-off region, in particular a perforation or other material weakening. As a result, the handling is greatly facilitated, and cushioning materials of very different sizes can easily be generated by the user for very different packaging scenarios. For example, a cushioning material can be produced, which consists only of a single sheetlike element, or a cushioning material can be produced which consists of a plurality of sheetlike elements that remain connected to each other via the tear-off region.

Hereinafter, embodiments of the invention will be explained with reference to the accompanying drawings. In the drawing.

Hereinafter, in different embodiments, the same reference numerals will be used for regions and elements having equivalent functions. In addition, in subsequent embodiments, only differences from previous embodiments are discussed for the most part.

Figure 1:
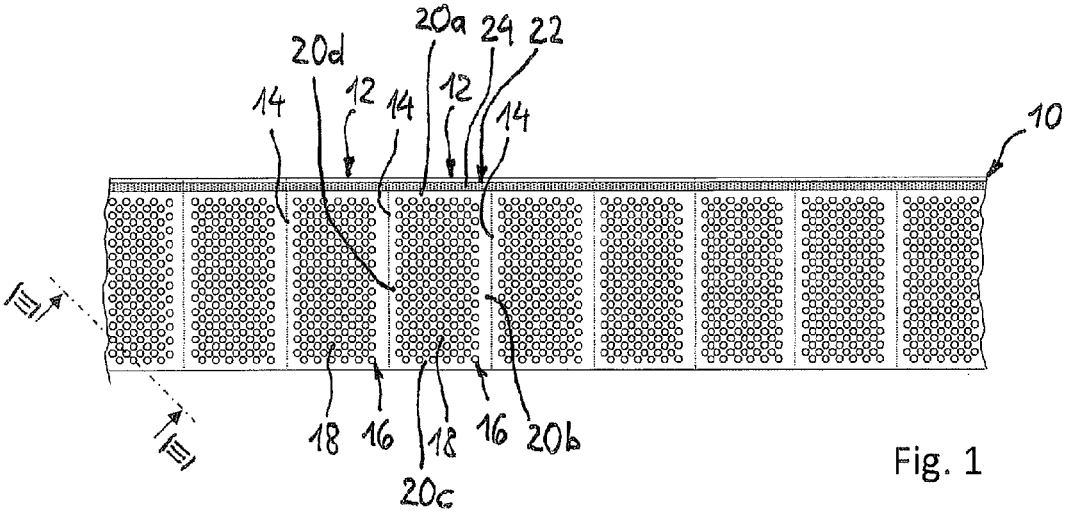
FIG. 1 is a plan view of a first embodiment of a cushioning material.

In FIG. 1, a cushioning material for packaging purposes bears the reference numeral 10 as a whole. It is designed as an elongated strand of paper (for example packaging paper) with an exemplary density in the range of 40-60 g/m$^2$ and comprises a plurality of sheetlike elements 12, which in the present case have a rectangular shape in the illustrated plan view. In principle, however, almost any other shapes are conceivable. For reasons of clarity, only two juxtaposed sheetlike elements 12 are provided with a reference numeral in FIG. 1. The sheetlike elements 12 are detachably connected to each other by means of a tear-off region 14, in the present case a linear perforation. As an alternative or in addition to the perforation, the tear-off region could also have a different material weakening, for example a smaller thickness, or it could be made of a material having a lower tear strength than the rest of the sheetlike element 12.

Figure 3:
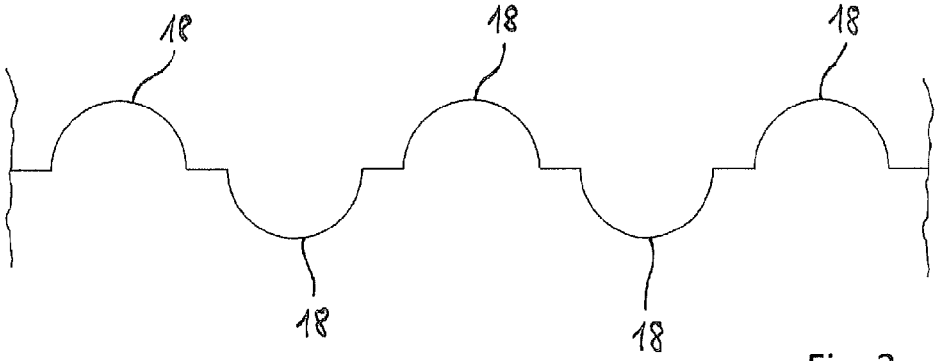
FIG. 3 is a section along the line III-III of FIG. 1.

Each of the sheetlike elements 12 has a central and generally also approximately rectangular cushion portion 16, which is formed by a plurality of bulges 18 which extend perpendicular to the plane of the drawing of FIG. 1. Again, for reasons of clarity, only a single bulge 18 in FIG. 1 is provided with a reference numeral. As can be seen from the sectional view of FIG. 3, the bulges 18 are hemispherical. By way of example, you can have a radius in the range of 0.5-1.5 cm, preferably 1 cm. As can also be seen from the sectional view of FIG. 3, a bulge 18 toward one side of the sheetlike element 12 is adjacent to a bulge 18 toward the other side of the sheetlike element 12. The direction of the bulges 18 thus changes, so that the cushioning material 10 has a total thickness which corresponds approximately to twice the radius of the bulges.

In the present embodiment, the bulges 18 are indeed hemispherical in section. It is understood, however, that other cross sections of bulges are possible, for example, rectangular, square, elliptical, spherical, triangular, etc. Moreover, in the plan view shown in FIG. 1, the bulges 18 can also have a different shape than the circular shape shown here. Also in this case, a triangular, rectangular, polygonal, elliptical or prismatic basic shape is possible in principle. In this way, very different, for example, also cubic, pyramidal, conical and truncated cone-shaped bulges can be produced. The bulges 18 in the thickness direction of the cushioning material, in FIG. 1, thus, perpendicular to the drawing plane, enables an elastic compression, whereby a property desired for protecting an item to be packaged is provided. For example, a packaged item is protected by this cushioning material from damage and impact. In principle, such a property could also be provided in other ways, for example by hermetically sealed air chambers, as are known from bubble wrap or from air-filled bags, by a foam material, a crumpling of paper, etc.

Each of the sheetlike elements 12 furthermore has a total of four rectangularly extending edge portions 20*a* to 20*d* which surround the upholstery portion 16 of a sheetlike element 12 and in which in the present case, for example, no bulges 18 are present. These 4 edge portions 20*a* to 20*d* are drawn into FIG. 1, again for reasons of clarity, for only one sheetlike element 12. In the first embodiment of a cushioning material 10 shown in FIG. 1, an adhesive system 22 is applied only on a single edge portion of a sheetlike element 12, namely on the upper edge portion 20*a* in FIG. 1. Since the two edge portions 20*a* and 20*c* form the shorter pair of edge portions of the rectangular sheetlike element 12, they are transverse edge portions. This adhesive system 22 comprises a continuous strip of adhesive 24 extending along the edge portion 20*a*.

The adhesive system 22 is designed so that it can be connected to another portion, for example, the opposite edge portion 20*c* of the same sheetlike element 12, but can be released from it without use of an auxiliary means and nondestructively. Furthermore, the adhesive system 22 is designed so that it can be used after the release at least one more time for a reattachment.

Such an adhesive principle of such adhesive layers, which have a so-called "sticky note adhesive effect," is known, for example, from note papers which are known on the market under the brand name "Post-it®." The adhesive used for this is a hardened plastic which consists of tiny little beads with fine hairs. These hairs act like tentacles that hold the note paper (or in the present case the edge portion 20*a*) on the desired substrate (or in the present case, for example, on the edge portion 20*c*). The note paper (or the edge portion 20*a*) can be easily removed again because the contact area between the note paper and the substrate is reduced by the small beads. If the said hairs do not break off or become soiled with dust, such a note paper (or in the present case the edge portion 20*a*) can be adhered to a substrate many times, detached from it, adhered back to a substrate and released again, etc.

With regard to the dimensions, the cushioning material 10 may have a tear-off region 14 approximately every 20 cm, for example in the longitudinal direction of the strand shown in FIG. 1. The length of a longitudinal edge portion 20*b* and 20*d* may be approximately 40 cm, for example, the length of a transverse edge portion 20*a* and 20*c* may be approximately 20 cm.

Figure 2:
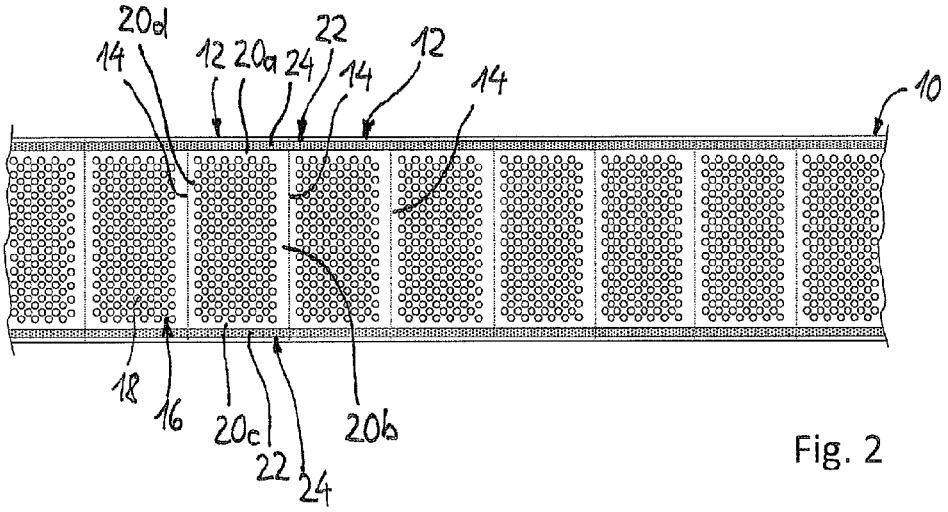
FIG. 2 is a plan view of a second embodiment of a cushioning material.

In the case of the second embodiment of a cushioning material 10 shown in FIG. 2, there is a continuous adhesive strip 24 extending along the respective edge portion 20*a* and 20*c* not only on one transverse edge portion 20*a* but on the two opposing transverse edge portions 20*a* and 20*c*.

Figure 4:
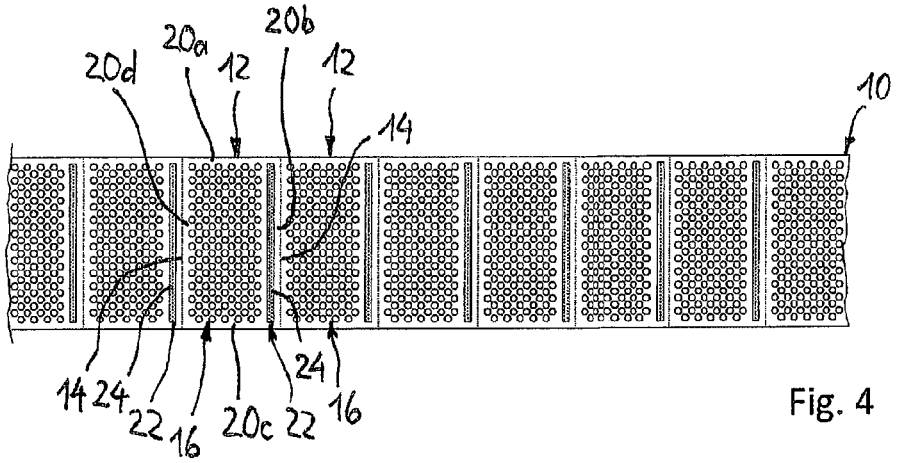
FIG. 4 is a plan view of a third embodiment of a cushioning material.

In the third embodiment of a cushioning material 10 shown in FIG. 4, no adhesive strip is present at the transverse edge portions 20*a* and 20*c*, whereas on the right longitudinal edge portion 20*b* in FIG. 4 there is a continuous adhesive strip 24 extending along the longitudinal edge portion 20*b*.

Figure 5:
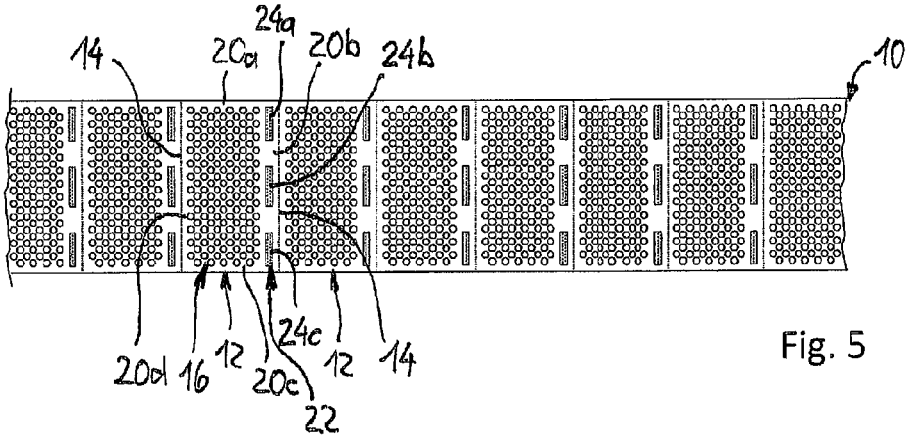
FIG. 5 is a plan view of a fourth embodiment of a cushioning material.

In the fourth embodiment of a cushioning material 10 shown in FIG. 5, instead of the continuous adhesive strip 24 shown in FIG. 4, there is a non-continuous adhesive strip 24, which in this respect consists of four longitudinal and straight segments 24*a*, 24*b* and 24*c*.

Figure 6:
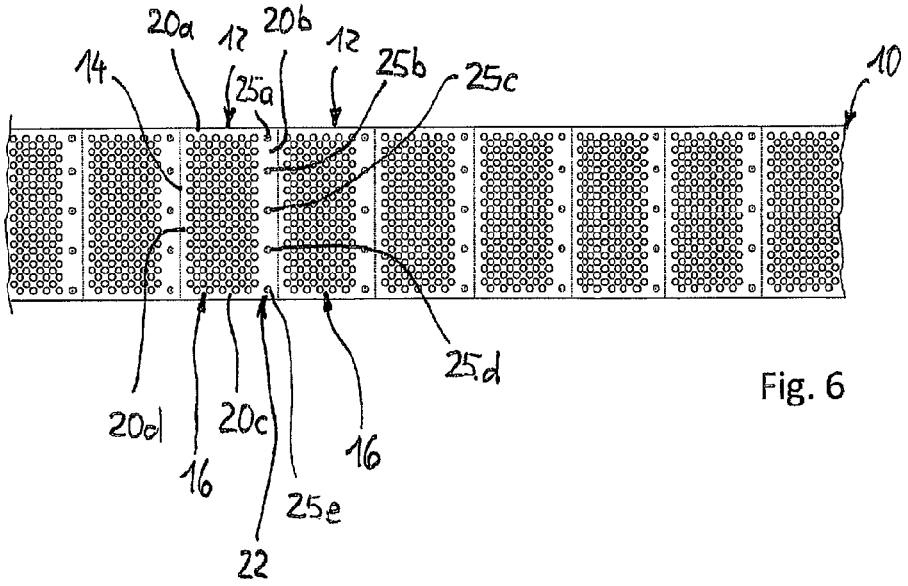
FIG. 6 is a plan view of a fifth embodiment of a cushioning material.

In the fifth embodiment of a cushioning material 10 shown in FIG. 6, instead of the elongated segments shown in FIG. 5, a plurality of point-shaped adhesive dots 24*a* to 24*e* are present.

Figure 7:
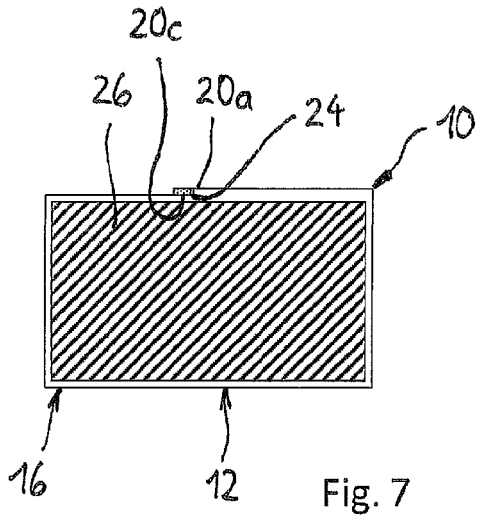
FIG. 7 is a schematic sectional view through an item which is wrapped with a cushioning material having a single sheetlike element.

FIG. 7 shows how an item 26 can be wrapped with the cushioning material 10 shown only schematically and without the bulges 18. In the present case, a single sheetlike element 12 is used for this purpose whose one transverse edge portion 20*a* has, for example, an adhesive system 22 with a continuous adhesive strip 24 corresponding to the first embodiment in FIG. 1. It can be seen that, by means of the adhesive strip 24, the transverse edge portion 20*a* is connected to the other transverse edge portion 20*c*.

However, it should be understood that if the item 26 had dimensions such that, when the item 26 is wrapped more or less tightly with the sheetlike element 12 of the cushioning material 10, the transverse edge portion 20*a* does not coincide exactly with the other transverse edge portion 20*c*, the adhesive strip 24 of the transverse edge portion 20*a* could also be releasably connected to the cushion portion 16 extending between the two transverse edge portions 20*a* and 20*c*, even if the contact surface would be smaller due to the bulges 18.

In general, one proceeds as follows when the item 26 is to be provided with the cushioning material 10: first, the item 26 is wrapped with the sheetlike element 12. Then, the edge portion 20*a* of the planar element 12 is connected to the other edge portion 20*c* of the planar element 12 by means of the releasable adhesive system 22.

Figure 8:
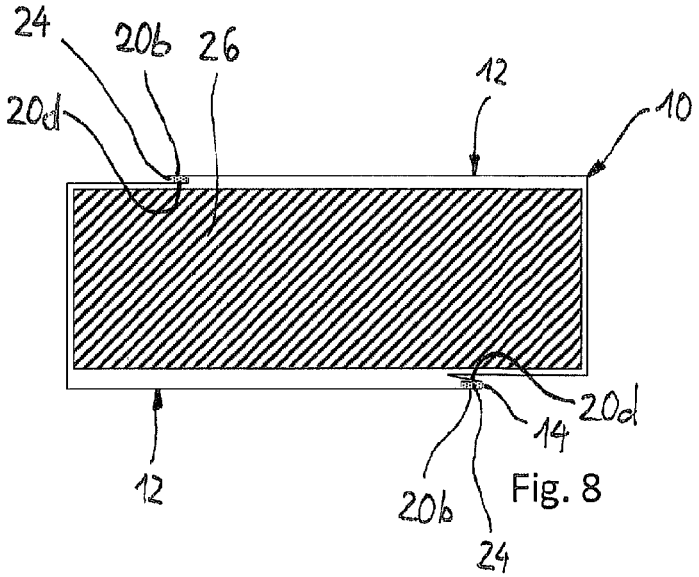
FIG. 8 is a schematic sectional view through an item which is wrapped with a cushioning material having a plurality of sheetlike elements.

FIG. 8 shows how an item 26 with a cushioning material 10 corresponding to the cushioning material 10 of FIG. 4 can be wrapped with two sheetlike elements 12. The two sheetlike elements 12 are still connected to each other in the region of the tear-off region 14. In order to avoid the adhesive strip 24 present there adhering to the item 26, the longitudinal edge 20*d* of the one sheetlike element 12 is folded over in the region of the tear-off region 14 and thus brought between the item 26 and the adhesive strip 24 of the other sheetlike element 12.

Figure 9:
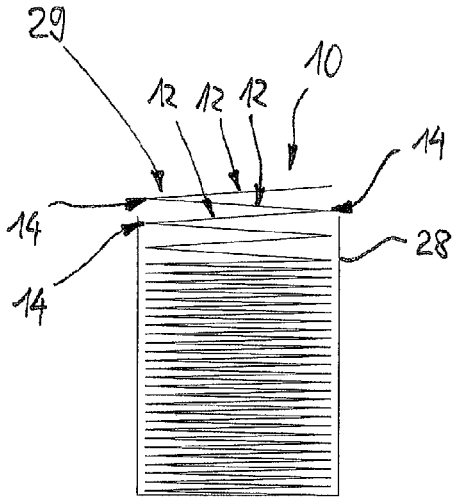
FIG. 9 is a schematic sectional view through a container in which a cushioning material is stored.

As can be seen from FIG. 9, the cushioning material 10 in a storage state can comprise a plurality of sheetlike elements 12 which are detachably connected to one another in a zig-zag fold, which is preferably present in the region of the tear-off region 14, and are stocked in a container 28 in the form of a stack 29. To retrieve the cushioning material 10, the container 28 is opened at the top and the necessary amount of associated sheetlike elements 12 is retrieved by tearing them off along the tear-off region 14.

Figure 10:
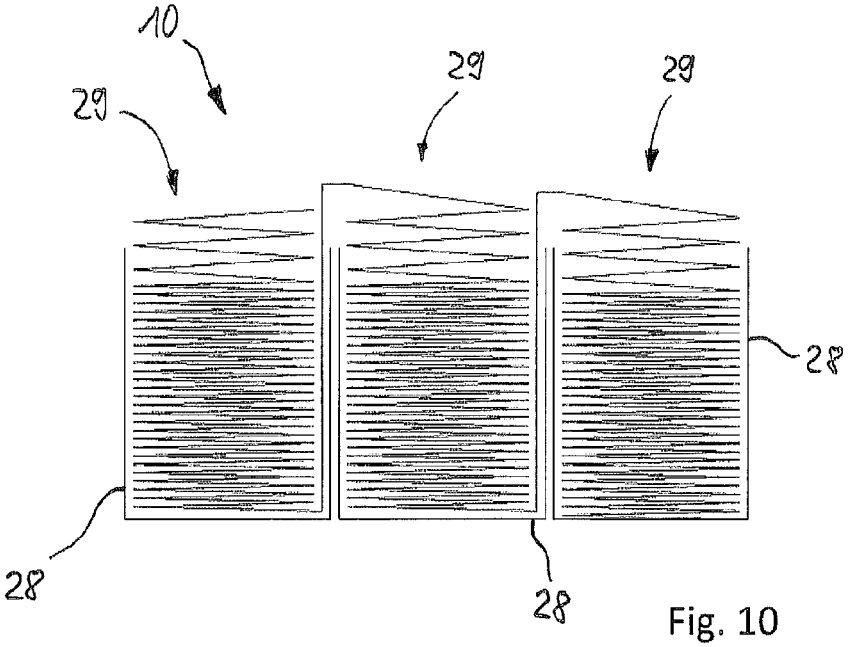
FIG. 10 is a schematic sectional view through a plurality of containers in which interconnected cushioning material is stored.

In particular if the cushioning material 10 is provided by an automated device, as will be explained hereinafter, the supply of cushioning material 10 can be increased by having the lower end of the one stack 29 of sheetlike elements 12 of a container 28 connected to the upper end of the stack 29 of sheetlike elements 12 of an adjacent container 28, as shown in FIG. 10.

Figure 11:
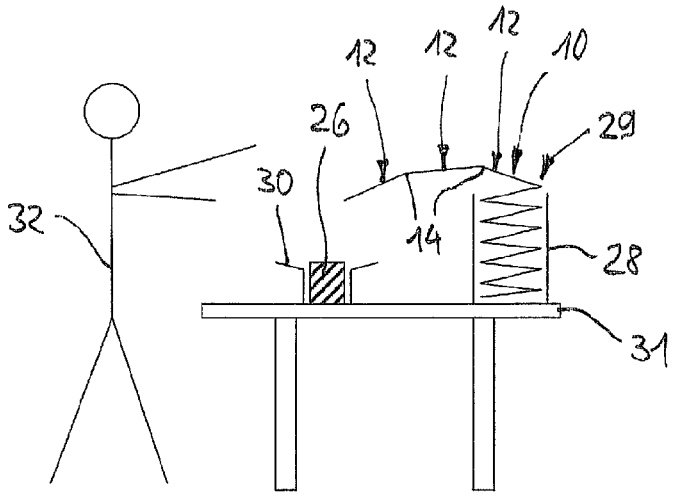
FIG. 11 is a schematic sectional view through a first use scenario of cushioning material.

FIG. 11 shows a first use scenario of the cushioning material 10 described above in its various variants. A container 28 with cushioning material 10 is sitting on a table 31, likewise a container 30 with an item 26 to be packaged. A user 32 can retrieve the desired amount of sheetlike elements 12 of the cushioning material 10 from the container 28, separate it from the remainder of cushioning material 10 remaining in the container 28 along the tear-off region 14, and thus wrap the item 26, as shown, for example, in FIGS. 7 and 8.

Figure 12:
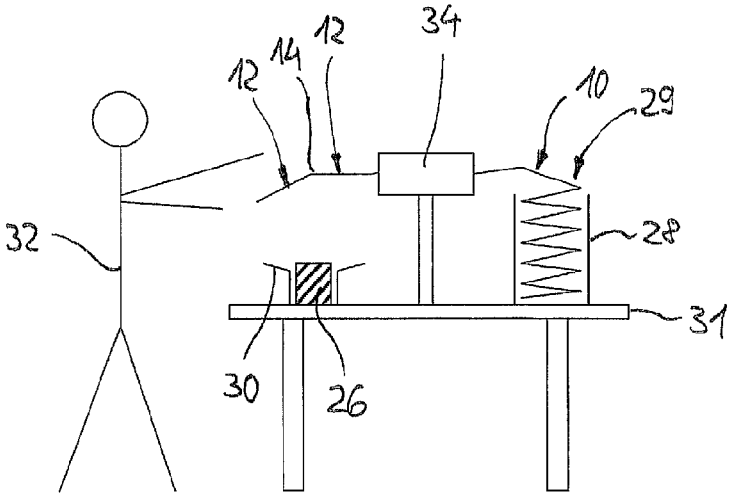
FIG. 12 is a schematic sectional view through a second use scenario of cushioning material.

For ease of use, an automated device 34, such as a conveyor driven by electric motor, may additionally be used to provide the cushioning material 10 to the user 32. Such a second use scenario is shown in FIG. 12. The automated device 34 is also on the table 29. For the most effective operation, the automated device 34 has a user interface (not depicted) through which the user can operate the automated device 34.

This user interface may comprise, for example, a foot switch, which upon actuation provides a pre-set amount of sheetlike elements 12 by their being conveyed by electric motor and automatically separated from the remaining sheetlike elements 12 along a tear-off region 14 after the conveyance is terminated. For this purpose, two driven roller pairs, for example, arranged successively in the conveying direction may be provided in the automated device 34*d*, between which roller pairs the cushioning material 10 is conveyed, the roller pair arranged away from the user 32 being stopped briefly for the tearaway operation, whereas the roller pair placed next in succession toward the user 32 continues to be driven. However, it is also possible to use a cutting device to separate the desired quantity of sheetlike elements 12 from the sheetlike elements 12 of the stack 29.

Instead of a foot switch, a voice control (microphone), a gesture control (image recognition by camera), a touchpad, a classic keyboard, etc. are conceivable as a user interface. In principle, it is also conceivable to detect via a sensor at the output of the automated device 34 if the user 32 is retrieving or has retrieved a quantity of cushioning material 10, and then automatically to provide a preset amount of cushioning material 10 again.

Figure 13:
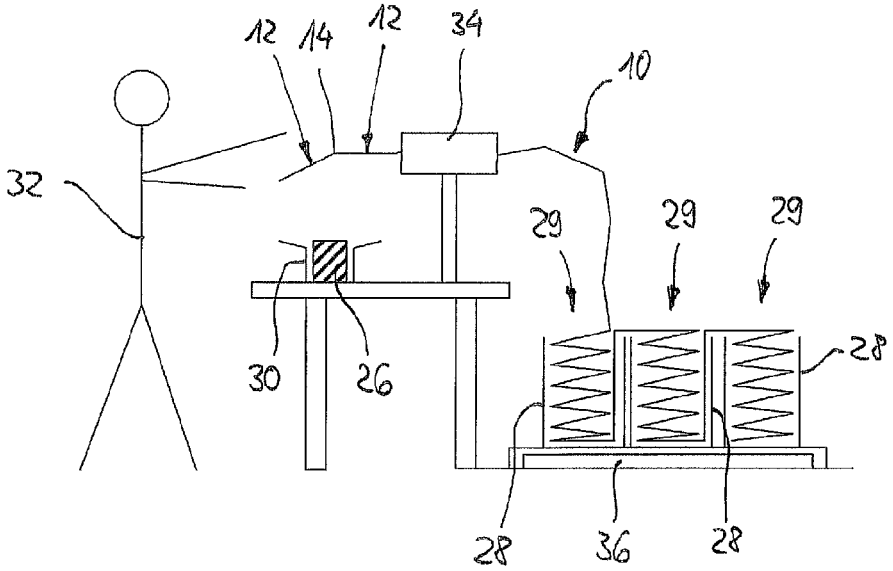
FIG. 13 shows a schematic sectional view through a third use scenario of cushioning material.

FIG. 13 shows a third use scenario which is very similar to the second use scenario of FIG. 12. It differs only in that the cushioning material 10 is not stored on the table 29, so that the table 29 can be smaller overall. Instead, three containers 28, for example, are present on a pallet 36 on the floor behind the table. The cushioning material in the three containers 28 is interconnected as discussed above in connection with FIG. 10. It is understood that the number of three containers 28 in both FIG. 10 and FIG. 13 is merely exemplary. Of course, a smaller or larger number of containers 28 containing cushioning material 10 is also conceivable, the cushioning material 10 of a container 28 being connected to the cushioning material 10 of the adjacent container 28, so that a very large stock of cushioning material 10 is formed.

Finally, it is also conceivable in principle that a starting material that is flat and does not yet have bulges is stored in the containers 28, and that the bulges are produced in the sheetlike starting material, for example by embossing, heating and/or moistening/drying, etc., only when it passes through the automated device 34. The tear-off regions 14 may already be present in the starting material, but may likewise be generated only when passing through the automated device 34. It is also possible to use a cushioning material 10 which has no tear-off regions 14 at all, and in which the individual sheetlike elements 12 are separated as required by a cutting device, for example. In particular when a starting material is flat and does not yet have the bulges is used, the starting material may also be wound on a roll.

The invention claimed is:

1. A cushioning material for packaging purposes, comprising at least one sheetlike element, having at least one edge portion delimiting the sheetlike element and a cushion portion, the cushion portion providing a cushioning property desired for protecting an item to be packaged, wherein the at least one edge portion is at least partially provided with an adhesive system which is designed for such a connection to another portion of another sheetlike element or of the same sheetlike element, the connection being releasable without any auxiliary means, that is, without special heating and without special tools, and non-destructively, that is, without damaging the cushion material or the item, wherein the cushion portion is made of a paper or cardboard material in which a plurality of bulges is formed.

2. The cushioning material according to claim 1, wherein the adhesive system is designed so that it can be used after releasing at least one more time for a reattachment, in particular that the adhesive system has an adhesive layer with a reusable adhesive effect.

3. The cushioning material according to claim 1, wherein the adhesive system comprises an adhesive strip extending continuously along the edge portion.

4. The cushioning material according to claim 3, wherein the sheetlike element is rectangular in plan view, and that the edge portion on which the adhesive system is applied, is at least one longitudinal edge portion and/or at least one transverse edge portion.

5. The cushioning material according to claim 1, wherein the adhesive system comprises a non-continuous adhesive strip extending along the edge portion and/or individual adhesive dots.

6. The cushioning material according to claim 1, wherein a bulge toward one side of the sheetlike element is adjacent to a bulge toward the other side of the sheetlike element.

7. A method for cushioning an item with the cushioning material of claim 1, comprising the following steps:

wrapping the item with the sheetlike element or a plurality of associated sheetlike elements; and fastening the at least one edge portion of the sheetlike element or the sheetlike elements by means of the adhesive system, in particular with another edge portion of the sheetlike element or of another sheetlike element.

8. A cushioning material for packaging purposes, comprising at least one sheetlike element, having at least one edge portion delimiting the sheetlike element and a cushion portion, the cushion portion providing a cushioning property desired for protecting an item to be packaged, wherein the at least one edge portion is at least partially provided with an adhesive system which is designed for such a connection to another portion of another sheetlike element or of the same sheetlike element, the connection being releasable without any auxiliary means, that is, without special heating and without special tools, and non-destructively, that is, without damaging the cushion material or the item, wherein the sheetlike element is detachably connected to a further sheetlike element, at least in a storage state, by means of a tear-off region, in particular a perforation or other material weakening.

9. A cushioning material for packaging purposes, comprising at least one sheetlike element, having at least one edge portion delimiting the sheetlike element and a cushion portion, the cushion portion providing a cushioning property desired for protecting an item to be packaged, wherein the at least one edge portion is at least partially provided with an adhesive system which is designed for such a connection to another portion of another sheetlike element or of the same sheetlike element, the connection being releasable without any auxiliary means, that is, without special heating and without special tools, and non-destructively, that is, without damaging the cushion material or the item, wherein in a storage state it comprises a plurality of sheetlike elements that are releasably connected to each other in a zig-zag fold.

* * * * *